US005948362A

United States Patent [19]

Steinbrenner et al.

[11] Patent Number: 5,948,362

[45] Date of Patent: Sep. 7, 1999

[54] DEVICE FOR ARRANGING A PLURALITY OF OBJECTS ON A SUPPORT

[76] Inventors: Bernd Steinbrenner, Mozartstrasse 8, D-69257 Wiesenbach; Roger Steinbrenner, Zum Tannenkopf 41, D-69412 Eberbach, both of Germany

[21] Appl. No.: 08/793,499

[22] PCT Filed: Sep. 7, 1995

[86] PCT No.: PCT/EP95/03520

§ 371 Date: Feb. 28, 1997

§ 102(e) Date: Feb. 28, 1997

[87] PCT Pub. No.: WO96/07480

PCT Pub. Date: Mar. 14, 1996

[30] Foreign Application Priority Data

Sep. 8, 1994 [DE] Germany ..... 44 31 946
Oct. 12, 1994 [DE] Germany ..... 44 36 473

[51] Int. Cl.[6] ..... B65D 85/30; B65L 9/00

[52] U.S. Cl. ..... 422/100; 422/104; 206/499; 206/486; 206/562

[58] Field of Search ..... 422/100, 99, 104; 206/499, 486, 503, 506, 507, 563, 562

[56] References Cited

U.S. PATENT DOCUMENTS

| | | | |
|---|---|---|---|
| 1,728,454 | 9/1929 | Sterling . | |
| 3,905,178 | 9/1975 | West | 53/328 |
| 4,130,978 | 12/1978 | Cohen | 53/444 |
| 4,349,109 | 9/1982 | Scordato et al. | 206/557 |
| 5,392,914 | 2/1995 | Lemieux et al. | 206/499 |
| 5,441,702 | 8/1995 | Lemieux et al. | 422/100 |
| 5,470,538 | 11/1995 | Lind | 422/104 |

FOREIGN PATENT DOCUMENTS

| | | |
|---|---|---|
| 2207914 | 9/1972 | Germany . |
| 3490484 | 10/1985 | Germany . |
| 9012424 | 11/1990 | Germany . |
| 9216674 | 3/1993 | Germany . |
| 9201514 | 2/1992 | WIPO . |
| 9533564 | 12/1995 | WIPO . |

OTHER PUBLICATIONS

Kleinfeld Labortechnik "Pipettenspitzen von Rainin sind Spitze" (company brochure) (no date).

Patent Abstracts of Japan, vol. 010, No. 237 (P–487), 15 Aug. 1986 & JP, A, 61 068563 (HAYASHI) 8 Apr. 1986.

Patent Abstracts of Japan, vol. 009, No. 281 (P–403), 8 Nov. 1985 & JP,A,60 122373 (HAYASHI KOGYO KK) 29 Jun. 1985.

*Primary Examiner*—Long V. Le
*Attorney, Agent, or Firm*—Paul Vincent

[57] ABSTRACT

The invention concerns a device for arranging a plurality of objects (1) on a support (4), the objects (1) being placed in layers (3) in apertured plates (5). These plates (5) are in turn stacked one above the other in a magazine (6) so as to save space. The respective lowermost apertured plate (5) containing objects (1) is released by the disengagement of a retaining element (7). The device is configured such that it is easy to handle and the magazines can accommodate a large number of layers (3) since the retaining element (7) can be disengaged by an actuating device which can be manipulated from the exterior of the magazine (6).

20 Claims, 3 Drawing Sheets

DEVICE FOR ARRANGING A PLURALITY OF OBJECTS ON A SUPPORT

BACKGROUND OF THE INVENTION

The invention concerns a device for arranging and removing pipette tips, wherein the pipette tips are arranged in apertured plates, the apertured plates being stacked in layers above each other in a magazine in a space-saving fashion.

Nearly every biological or medical laboratory uses specialized reciprocating pumps for handling and dosing the smallest of fluid volumes, so-called pipettes. In order to prevent contamination of the liquids and solutions being dispensed with the pipettes, contact with the fluid is effected via exchangeable disposable tips made from plastic which are attached to the lower end of the pipette. Same are utilized in great quantities in every laboratory.

The tips of the pipettes can be obtained in bulk form in bags and must then be individually attached to the pipettes by hand. This procedure has the intrinsic danger that the tips must be handled and therefore can become contaminated. In addition, this procedure is extremely time-consuming when a large quantity of pipettes is involved.

For ease of use it is therefore possible to purchase pipette tips attached to supports normally consisting of plastic, wherein the supports can be sealed by lids. The supports have apertured plates, wherein most manufacturers or retailers maintain a standard orthogonal 8×12 or 6×10 grid in dependence on the size of the pipette tips. In this fashion, easy removal of the pipette tips is guaranteed even in the event of multiple channel pipettes.

Sterile pipette tips are often required during laboratory work. Therefore, the supports are usually heatable up to approximately 120° C. so that the tips can be sterilized (treated in an autoclave) with moist heat prior to use. Such supports will be designated below as autoclave boxes.

In practice not only the pipette tips but, in particular, the autoclave boxes themselves constitute disposable articles, although they could, in principle, be utilized a plurality of times. The reason for this is that a reattachment of the tip by hand in the laboratory is too time-consuming and involves too much effort so that an autoclave box of this type is delivered along with each delivery of attached tips. Since this box must also be of very stable construction in order to withstand the pressure loads occurring when disposing the pipettes into the tips, a relatively large amount of material is required for its production. This leads to increased environmental pollution during manufacture and distribution (an individual carrier has to be produced, transported and packaged for 96 or 60 tips in each case) and requires the user to solve the problem of disposing of large amounts of plastic waste, causing pollution.

A device of the above-mentioned kind is known in the art from the brochure "Pipettenspitzen von Rainin sind Spitze" [Rainin pipette tips are tops] from the company Kleinfeld Labortechnik. Herein, a device has a retaining element comprising a narrowing on the lower end of the magazine, wherein release is effected by inserting the hand into the upper end of the magazine and pressing against the vertically stacked layers of pipette tips. The lower apertured plate thereby bends somewhat away from the narrowing as a result of which same is released or the narrowing moves aside. Towards this end it is necessary to insert the hand into the magazine from above. This results in an uncomfortable hand operation, particularly for the last layer located in the magazine. Insertion of the hand is associated with the danger of soiling the inside of the magazine and thereby the pipette tips. In addition, this type of construction leads to severe limitation in the number of layers which can be accommodated within a magazine.

A device of the above mentioned kind is furthermore known in the art from WO 92/01514. In this device, aperture plate-like mountings have holding tabs which serve for lifting the mounting, having the uppermost layer of pipette tips, for introduction to a support. The lifting of the mounting and the introduction of same having the tips into the support is a tedious manual operation considering the large quantity of tips which are necessary and which, in addition, has the danger of soiling the pipette tips. Furthermore, the pipette tips are not optimally stacked since the configuration of the spacers prevents mutual engagement to the extent which would be possible based on their geometry.

A device of the above mentioned kind is also known in the art from DE 92 16 674 U1. In this device support plates having layers of pipette tips are stacked above another and snapped into each other to form a magazine. The uppermost support plate is always removed and placed on a pan for laboratory use. In contrast to WO 92/01514, this device has the advantage that there is no need for introduction of the tips into the support, however the above mentioned disadvantages are not avoided.

The underlying purpose of the invention is to configure a device of the above-mentioned kind in such a fashion that a comfortable handling is possible and that the magazine can accept a large number of layers with the danger of soiling the objects being eliminated.

SUMMARY OF THE INVENTION

This purpose is achieved in an apparatus for arranging and removing pipette tips of the above mentioned kind in accordance with the invention in that, in each case, the lowermost layer of an apertured plate having pipette tips is releasable through disengagement of a retaining element to thereby position the lowermost apertured plate onto a support, and the retaining element is disengaged by means of an activation device which is manually operable from outside of the magazine and the retaining element has a narrowing, adapted for widening, on the lower end of the magazine by means of which the lowermost apertured plate is held at its outer edge and the activation device can be pressed against the upper edge of a support in such a fashion that the narrowing widens elastically to release the lowermost apertured plate.

The invention has the advantage that a significantly increased ease of handling is achieved with little expense. It is possible to construct the magazine with nearly arbitrary heights as a result of which a much more economical preparation of pipette tips is possible. In this manner, packing materials and storage space are minimized. The magazine can be closed at the top so that the pipette tips located in the magazine are well protected against soiling and contamination.

Stops can be provided for below the magazine by means of which a support can be safely positioned for acceptance of pipette tips. These could be sideward stops or could be a stop which limits a vertical displacement of the support or of the magazine for activation of the dispensing process. These stops can be configured in such a fashion that differing supports can be positioned below the magazine. A support of this kind can be a plate in which the pipette tips can be introduced or could be an autoclave box with an upper surface configured in the manner of an apertured plate. Same are also often removable from the usual autoclave box housing.

A stop which limits a substantial displacement of the support or the magazine and which serves for activation of the dispensing process can be dimensioned in such a fashion that the lowermost apertured plate having pipette tips falls downwardly for acceptance in the support by a height difference which corresponds at most to the height difference between two apertured plates stacked in the magazine and having pipette tips. A configuration of this type is advantageous for all embodiments which do not require holding the following plates to prevent dispensing of more than two apertured plates having pipette tips.

It is possible to provide for a frame which can be added to the lower end of the magazine to extend the walls of the magazine. A frame of this kind can assume a plurality of functions: The retaining element can be disposed therein and, in addition, the activation device for releasing the retaining element can be disposed on the frame. In addition, it is possible to locate the stops on the frame for use of the frame as an adaptor for differing supports. In this fashion, it is possible to deliver one model of magazine to the consumer who can then attach appropriate frames for filling different types of supports with pipette tips. In addition, such a frame can be provided with handles to facilitate placement of the magazine on a support. It is however also possible to use the frame as a mounting attached to a wall or the magazine having the frame can be inserted into such a wall mounting. If the magazine is configured with a frame of this kind, it is advantageous to close the top of the magazine such that it need not be opened by the user. In contrast thereto, a removable lid is provided for on the lower end of the magazine. The user can then place the new magazine on its head, remove the lid and attach the frame at the lower end of the magazine. The magazine is turned around, introduced, if appropriate, into a wall mounting and is ready for operation. The apertured plates having the pipette tips can also be secured for transport using fork-shaped mountings so that a rotation of the magazine is no longer necessary.

The activation device which is accessible from the outside can be configured in the most differing of fashions. For example, a configuration of the activation device can comprise parts of the magazine wall travelling diagonally outwardly in the vicinity of the narrowings. When the magazine is pushed against a support, e.g. an autoclave box, these diagonally travelling portions are pushed outwardly by the upper edges thereof to release the lowermost apertured plate. This configuration has the advantage that no manual operation is necessary over and above the placement of the magazine on the support and only a slight push against the upper edge of the support is sufficient for release. Clearly, the support can also be pushed against the magazine from below.

The narrowings can be disposed on two opposite sides of the magazine. With this latter configuration it is possible to provide the intermediately lying walls of the magazine with a flexible elastic joint or with slots which serve for easier opening to release the lowermost apertured plate.

A further embodiment provides that the activation device comprises at least two spring shackles disposed on opposite sides of the magazine walls having bevels facing the inside in such a fashion that a support pushed against these bevels pushes apart the front ends of the spring shackles, constituting narrowings, in such a fashion that the lowermost apertured plate is released. Two spring shackles can be provided for which extend along two longitudinal sides or along a substantial portion of these longitudinal sides, or it is also possible to provide two or more spring shackles on each side. This embodiment has the advantage of providing for a very simple but operationally reliable activation device which can be operated without additional manual procedures. An appropriately configured magazine or a magazine with a frame configured in this manner can be easily mounted on the wall and the support must only be pushed from below against the magazine or against the magazine having the frame in order to fill the support.

Similar to these above-described spring shackles, it is also possible to dispose vertically directed rocker-like levers on two opposite sides of the magazine walls, wherein the rocker-like levers have two hook-shaped ends facing inwardly, one of which always engages into the release path of the apertured plate in such a fashion that either the upper or lower end is engaged, wherein the separation between the hook-shaped ends is dimensioned in such a fashion that the upper hook-shaped ends engage below the following apertured plate when the lower hook-shaped ends release the lower apertured plate. This embodiment does not require a stop for the vertical motion of the support or of the magazine since an uncontrolled advancement of the next apertured plate with pipette tips located thereon, is ruled out from the outset. In this fashion, simple and extremely reliable manual operation is achieved. Resilient elements can be provided for to push the lower hook-shaped ends of the rocker-like levers into the engagement position. The upper hook-shaped ends are connected to an activation mechanism by means of which they can be pressed into the engagement location, wherein the lower hook-shaped elements simultaneously release an apertured plate having pipette tips.

A particularly advantageous configuration of the above-described rocker-like levers provides that the lower hook-shaped ends comprise leaf spring extensions having bevels configured in such a fashion that they pivot the rocker-like levers when the support is pushed in the upper direction against the bevels of the leaf spring extensions and the rocker-like levers pivot back when the support is removed. In this manner, an activation device is advantageously created which can be activated by pressing via a support, which does not require precise positioning against vertical stops, and which is extremely reliable in operation.

Handles can be disposed on the magazine for seating on the support. It is, however, also possible to introduce the magazine into a wall mounting for particularly simple handling with the magazine subsequently being operated in a manner similar to that of e.g. a soap dispenser. A pivotably retractable guard can be provided for the lower end of the magazine which serves to protect the tips of the pipettes from soiling in the operational position and can be pivoted away for dispensing. The magazine can also be suspended via a spring disposed on the upper end in such a fashion that it can be slightly lifted above the underlying surface to be pushed against a support located therebelow. The spring simultaneously secures the upright positioning.

A highly preferred embodiment of the invention may be viewed as a pipette tip storage and tip rack loading assembly, comprising a magazine constructed with approximately vertical sidewalls defining a storage volume. The storage volume has an open bottom shaped and dimensioned to register with a pipette tip rack contained within a population of similar such racks. Racks from this population are characterized by having an upper surface adapted to receive an array of pipette tips; for example by being interrupted with receptacles structured to receive individual pipette tips. The receptacles are arranged in a pattern, typically consisting of ranks and files. A plurality of support plates are positioned in vertical stacked arrangement within the storage volume of the magazine, each such plate being provided with apertures arranged in a pattern, and carrying an array of pipette tips installed in those apertures. Accordingly, the pipette tips of each such array, except the lowermost array, nest in the pipette tips of the next lower array in the stacked arrangement. Structural retaining elements are associated with the vertical sidewalls of the magazine, and are positioned to block the lowermost support plate of the stacked arrangement from exiting the open bottom of the magazine. The retaining elements are structured and arranged to interact with a pipette tip rack when the magazine is positioned in registration with the rack, whereby to release the lowermost support plate to move past the retaining elements towards the open bottom of the magazine. Thus, the pipette tips carried by the lowermost support plate drop, with the plate, into registration with the pipette tip rack, and a subsequent support plate of the stacked arrangement inevitably takes the lowermost position in the stack, effectively becoming a new lowermost support plate.

The retaining elements are desirably structured and arranged such that immediately upon removal of the magazine from a rack following release of a lowermost support plate of the stacked arrangement, the release elements operate to block in turn each succeeding new such lowermost support plate of the stacked arrangement. Ideally, the retaining elements comprise spring members carried by opposite side walls of the magazine. Generally, the spring members may each have a first, lower end anchored to a magazine sidewall and a second, upper end biased inward into blocking position with respect to the lowermost support plate. In the biased position, the spring elements provide a positive stop for the lowermost support plate inside the magazine, and prevent dispensing of tie support plate therefrom. The spring members may further be structured and arranged for engagement by a pipette tip rack inserted into the open bottom of the magazine, whereby the upper ends of the respective springs are forced against their biases out of blocking position, thereby releasing the lowermost support plate.

BRIEF DESCRIPTION OF THE DRAWING

Embodiments are represented in the drawings illustrating additional advantages.

DESCRIPTION OF THE PREFERRED EMBODIMENT

Figure 1:
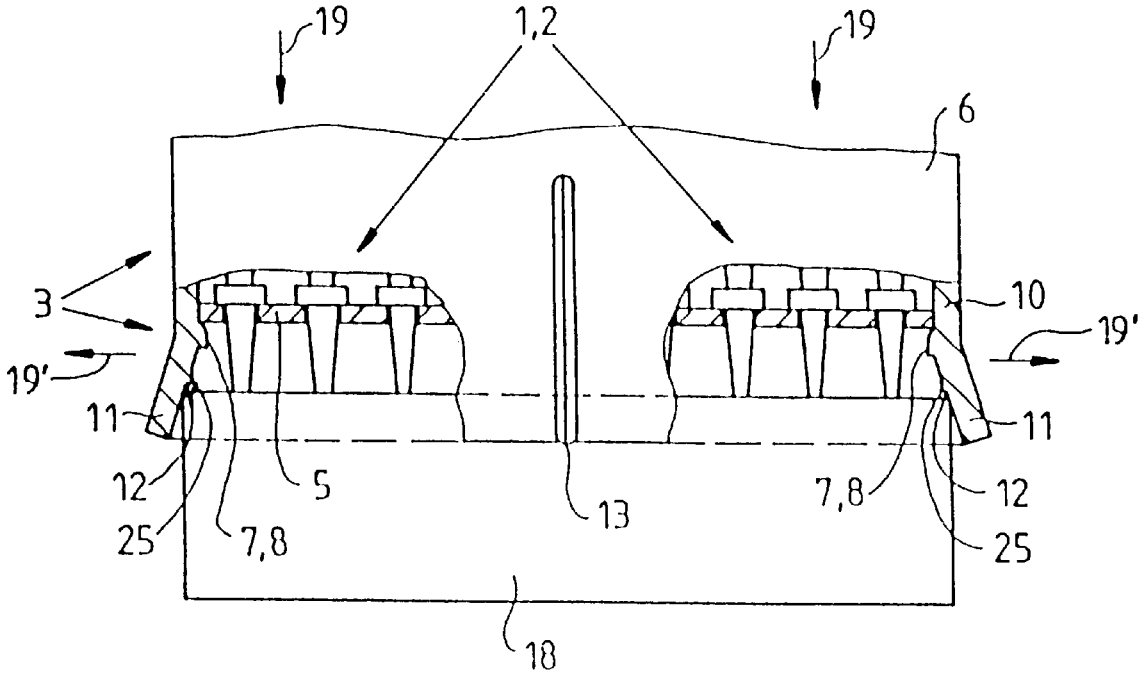
FIG. 1 shows a first embodiment.

FIG. 1 shows a first embodiment. Pipette tips 2 are located in a magazine 6 from which they are dispensed in a layered fashion to a support 4. The support 4 is generally configured as an autoclave box 18. The pipette tips 2 are located on apertured plates 5 in the magazine 6. These apertured plates 5 having the pipette tips 2 are stacked above each other in a plurality of layers 3, wherein a space-saving stacking is effected in that, in each case, one layer 3 of pipette tips 2 engages with the tips into the bore holes of the next layer of pipette tips 2.

The lowermost apertured plate 5 is held by retaining elements 7 which e.g. are configured as narrowings 8 having two enlargements located on opposite sides. Dispensing of the pipette tips 2 with the apertured plate 5 on the support 4 transpires in the embodiment shown through operation of diagonally outward travelling portions 11 of the magazine wall 10. These diagonally outward travelling portions 11 must be disposed on at least two opposite magazine walls 10, in fact on those at which the narrowings 8 are located. Same are configured in such a fashion that the magazine walls 10 move out of the way when the magazine 6 is pressed onto the autoclave box 18 or vice versa—in any event, the upper edges 12 push against the diagonally travelling portions 11. In this fashion the narrowings 8 release the lowermost apertured plate 5 having the pipette tips 2. The apertured plate 5 with the pipette tips 2 falls onto the support 4 which has bore holes corresponding with those of the apertured plate 5. The support 4 is previously brought into the proper position with the assistance of stops, wherein a stop 25 provides for a proper vertical positioning as a result of which the support 4 is positioned in such a fashion that the lowermost apertured plate 5 having pipette tips 2 falls in a downward direction for acceptance by the support 4 by a height difference 26 which corresponds at most to the height difference 26 between the apertured plates 5 having pipette tips 2 stacked in the magazine 1.

The stack of pipette tips 2 advances with the apertured plates 5 and comes to rest following dispensing. Stops 25 assure a proper height difference for guaranteeing that the following apertured plate 5 again enters the holding position, the stops 25 being configurable in the form of nubs seated on the diagonally travelling portions 11. Lifting of the magazine 6 or removal of the autoclave box 18 causes the magazine walls 10 to move towards each other, wherein the narrowings 8 again hold the next apertured plate 5. Arrows 19 signify the pressure which is to be exercised on the magazine 6 so that the outwardly travelling portions 11 move in the direction of arrows 19' to thereby release the lowermost apertured plate 5. In the event that the material of the magazine 6 is not sufficiently elastic to displace to a sufficient extent, it is possible for the magazine walls 10 lying between the magazine walls 10 having the narrowings 8 to be configured with slots or flexible elastic joints 13 to facilitate the widening.

Figure 2:
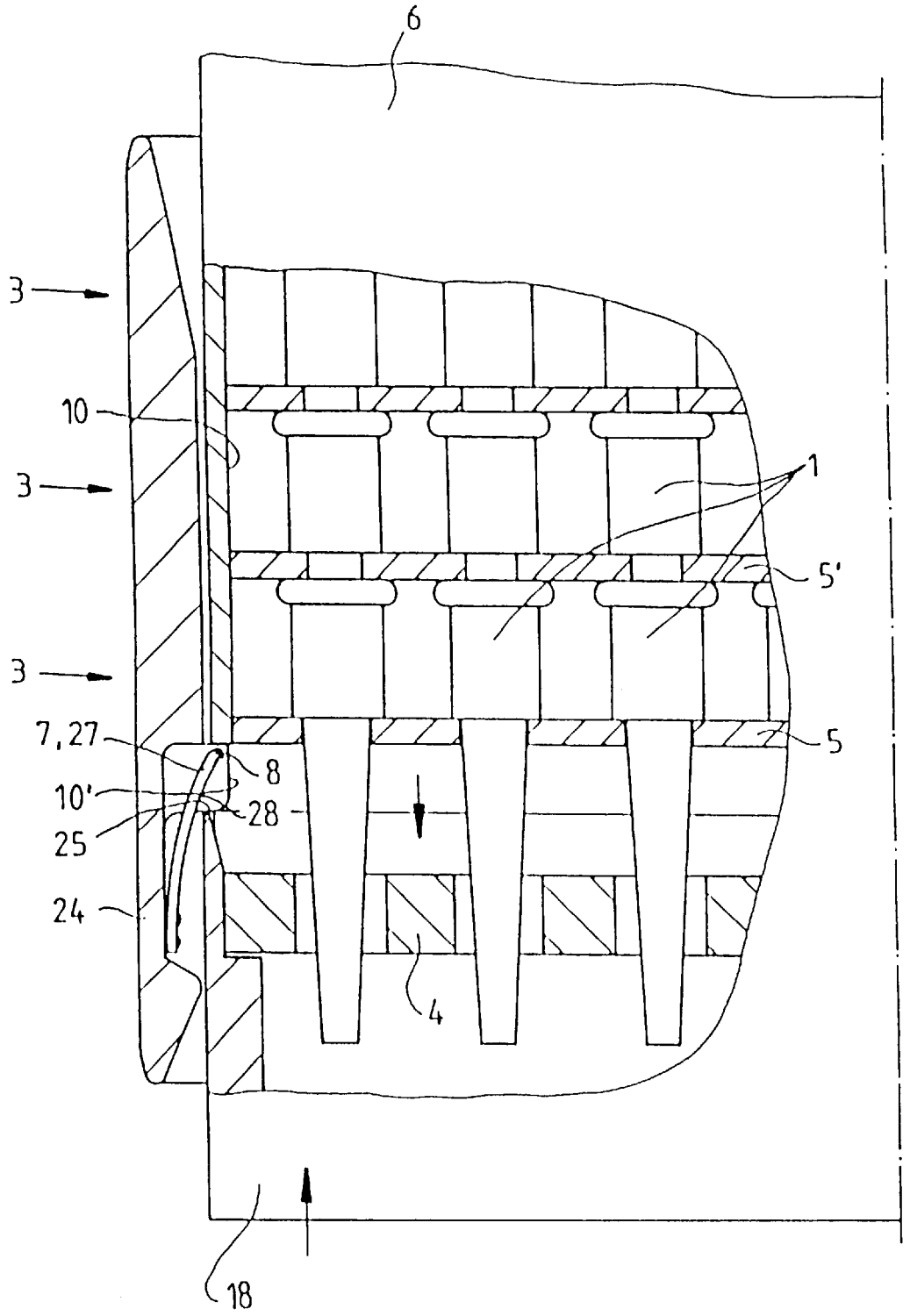
FIG. 2 shows a second embodiment with spring shackles.

FIG. 2 shows a second embodiment with which spring shackles 27 serve as retaining elements 7. The representation of the corresponding section of the magazine 6 and the support 4 is only one-sided, since the other half is symmetric to the half shown. The magazine 6 is provided with a frame 24 prior to operation having the retaining element 7 and the activation device. At least two spring shackles 27, disposed on opposite sides of the magazine walls 10, 10', are provided for as retaining elements 7 and activation device. Same could be two spring shackles 27 which extend along the length of two opposite sides or along a substantial portion of two opposite sides or two or more spring shackles 27 can be provided on each of the opposite sides of the magazine walls 10 or 10'. The spring shackles 27 have bevels 28 facing inwardly such that a support 4 pushed against these bevels 28 pushes apart the front ends of the spring shackles 27, functioning as narrowings 8, in such a fashion that the lowermost apertured plate 5 is released. Towards this end a stop 25 can facilitate the vertical positioning of the support 4 already mentioned above. Introduction of the support 4, which can be configured as an autoclave box 18, as well as the dispensing of the lowermost apertured plate 5 are indicated by arrows.

Figure 3:
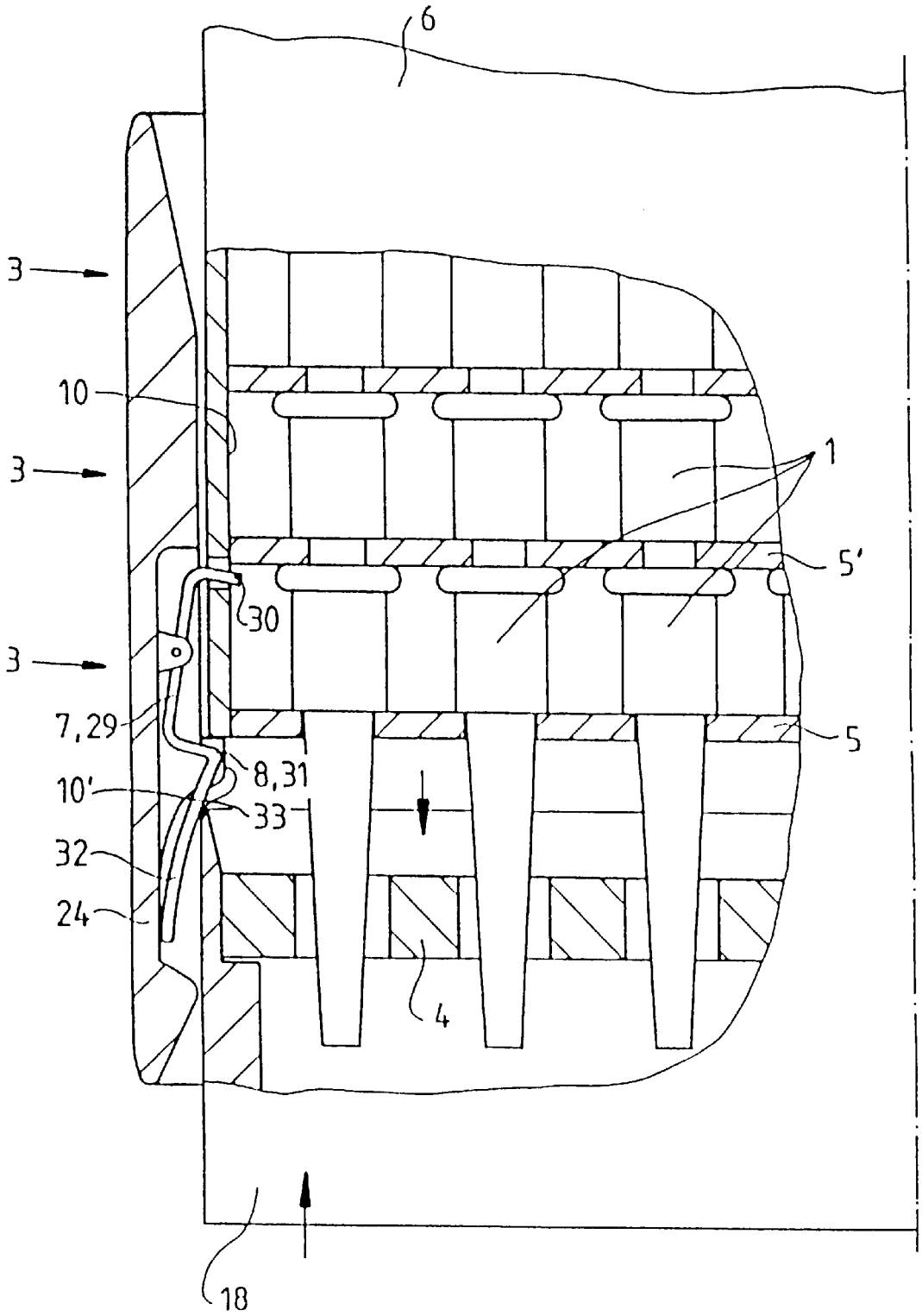
FIG. 3 shows a third embodiment having rocker-like levers.

FIG. 3 shows a third embodiment having rocker-like levers 29. As already described in connection with FIG. 2, this magazine 6 is also provided with a frame 24 which contains the retaining element 7 and the activation device. Same comprises rocker-like levers 29 disposed on two opposite sides of the magazine walls 10, 10'. The rocker-like levers 29 have two hook-shaped ends 30 and 31 one of which always engages into the dispensing path of the apertured plates 5 and does so in such a fashion that either the upper 30 or the lower end 31 is engaged. The separation between the hook-shaped ends 30 and 31 is dimensioned in such a fashion that the upper hook-shaped end 30 engages below the following apertured plate 5' when the lower hook-shaped ends 31 release the lower apertured plate 5. Similar to the above described spring shackles 27, the rocker-like levers 29 can also be configured with the described length or each of the opposite sides is provided with two or more such levers. In the embodiment shown leaf spring extensions 32 are contiguous with the hook-shaped ends 31 of the rocker-like levers 29, the leaf spring extensions 32 having bevels 33 configured in such a fashion that upward pressing of a support 4 pushes same against the bevels 33 of the leaf spring extensions 32 to pivot the rocker-like levers 29 to a sufficient extent that the lower hook-shaped ends 31 become disengaged and the upper hook-shaped ends 31 become engaged. In this manner the following apertured plate 5' is held and the lowermost apertured plate 5 released. In the event that the support 4 is removed again, the rocker-like levers 29 pivot back as a result of which the upper hook-shaped ends 30 release the following apertured plate 5' which falls sufficiently downward until it assumes the position of the dispensed apertured plate 5 prior to its release and is held at this location by the lower hook-shaped ends 31. Of course it is also possible to push the magazine against the support 4.

We claim:

1. Apparatus for positioning pipette tips on a support, the apparatus comprising:

a lower apertured plate for holding the pipette tips in a lower layer;

a magazine having a narrowing disposed at a lower end of said magazine to hold said lower apertured plate on an outer edge thereof;

a following apertured plate for holding the pipette tips in a following layer, within said magazine, said following apertured plate stacked above said lower apertured plate in said magazine; and an activating device manually operatable from outside the magazine by cooperating with an upper edge of the support to widen said narrowing in an elastic fashion for releasing said lower apertured plate.

2. The apparatus of claim 1, further comprising a stop for positioning the support below said magazine.

3. Apparatus for positioning pipette tips on a support, the apparatus comprising:

a lower apertured plate for holding the pipette tips in a lower layer;

a magazine having a narrowing disposed at a lower end of said magazine to hold said lower apertured plate on an outer edge thereof;

a following apertured plate for holding the pipette tips in a following layer within said magazine, said following apertured plate stacked above said lower apertured plate in said magazine;

an activating device manually operatable from outside the magazine and cooperating with an upper edge of the support to widen said narrowing in an elastic fashion for releasing said lower apertured plate; and a stop for positioning this support below said magazine, said stop being dimensioned to release said lower apertured plate in a downward direction for reception in the support by a first height difference which is less than or equal to a second height difference between said lower and said upper following apertured plate when stacked in said magazine.

4. The apparatus of claim 1, further comprising a frame for attachment on said lower end of said magazine for extending magazine walls.

5. The apparatus of claim 4, wherein said narrowing and said activating device are mounted in said frame.

6. The apparatus of claim 4, further comprising a stop for positioning the support below said magazine, said stop being disposed on said frame.

7. The apparatus of claim 1, wherein said magazine comprises magazine walls having diagonally outward travelling portions functioning as said activation device and disposed to communicate with said narrowing.

8. The apparatus of claim 1, wherein said narrowing comprises a first narrowing disposed on a first side of said magazine and a second narrowing disposed on a second side of said magazine, said first side opposite said second side, said magazine comprising an intermediate magazine wall disposed between said first and said second narrowing and having a flexible elastic joint.

9. Apparatus for positioning pipette tips on a support, the apparatus comprising:

a lower apertured plate for holding the pipette tips in a lower layer;

a magazine having a narrowing disposed at a lower end of said magazine to hold said lower apertured plate on an outer edge thereof;

a following apertured plate for holding the pipette tips in a following layer within said magazine, said following apertured plate stacked above said lower apertured plate in said magazine;

an activating device manually operatable from outside the magazine and cooperating with an upper edge of the support to widen said narrowing in an elastic fashion for releasing said lower apertured plate, wherein said activating device comprises a first spring shackle disposed on a first magazine wall and a second spring shackle disposed on a second magazine wall, said second wall opposite said first wall, said first spring shackle having an inwardly facing first bevel and said second spring shackle having an inwardly facing second bevel, the support for pushing against said first and said second bevel to push apart a first front end of said first spring shackle and a second front end of said second spring shackle to release said lower apertured plate.

10. Apparatus for positioning pipette tips on a support, the apparatus comprising:

a lower apertured plate for holding the pipette tips in a lower layer;

a magazine having a narrowing disposed at a lower end of said magazine to hold said lower apertured plate on an outer edge thereof;

a following apertured plate for holding the pipette tips in a following layer within said magazine, said following apertured plate stacked above said lower apertured plate in said magazine; and an activating device manually operatable from outside the magazine and cooperating with an upper edge of the support to widen said narrowing in an elastic fashion for releasing said lower apertured plate, wherein said activating device comprises a first rocker-like lever disposed on a first magazine wall and a second rocker-like lever disposed on a second magazine wall, said second wall opposite said first wall, said first and said second rocker-like levers each having an upper and a lower hook-shaped end, wherein one of said upper and said lower hook-shaped ends protrudes into a dispensing path of said lower apertured plate, said upper ends engaging below said following apertured plate when said lower end released said lower apertured plate.

11. The apparatus of claim 10, further comprising a resilient element to push said lower end into engagement and an activation mechanism for pushing said upper hook-shaped end into engagement.

12. The apparatus of claim 10, wherein each of said lower hook-shaped ends have leaf spring extensions having bevels to pivot said first and said second rocker-like lever when the support is upwardly displaced against said bevels, wherein said first and said second rocker-like lever pivot back when the support is removed.

13. A pipette tip storage and tip rack loading assembly, comprising:

a magazine constructed with approximately vertical sidewalls defining a storage volume, said storage volume having an open bottom shaped and dimensioned to register with a pipette tip rack which has an upper surface disposed to receive pipette tips, said pipette tips being arranged in a pattern and carried by a support plate;

a plurality of support plates in vertical stacked arrangement within said storage volume, each plate being provided with apertures arranged in said pattern, and carrying an array of pipette tips installed in said apertures, such that the pipette tips of each said array, except the lowermost said array, nest in the pipette tips of the next lower array in said stacked arrangement; and structural retaining elements associated with said vertical sidewalls positioned to block the lowermost said support plate of said stacked arrangement from exiting said open bottom, said retaining elements being structured and arranged to interact with a pipette tip rack when said magazine is positioned in registration with said rack, whereby to release the lowermost said support plate to move past said retaining elements towards said open bottom so that said lowermost support plate and its associated pipette tip array drop into registration with said upper surface of said pipette tip rack, and a subsequent support plate of said stacked arrangement becomes a new lowermost said support plate, wherein said retaining elements are further structured and arranged such that immediately upon removal of said magazine from said rack following release of a lowermost support plate of said stacked arrangement said retaining elements operate to block in turn each succeeding new lowermost support plate of said stacked arrangement, wherein said retaining elements comprise spring members carried by opposite side walls of said magazine.

14. An assembly according to claim 13, wherein said spring members each have a first, lower end anchored to said sidewall and a second, upper end biased inward into blocking position with respect to said lowermost support plate, said spring members being structured and arranged for engagement by said pipette tip rack inserted into said open bottom of said magazine, whereby said upper ends are forced against their biases out of said blocking position.

15. A pipette tip storage and tip rack loading assembly, comprising:

a magazine, defining a storage volume and having a dispensing end;

a first lowermost support plate within said storage volume, said support plate being provided with apertures arranged in a pattern and adapted to hold a plurality of pipette tips in & first lowermost layer of pipette tips;

a plurality of pipette tips loaded into said apertures of said first lowermost support plate to constitute said first lowermost layer of pipette tips; and support plate stop mechanism disposed at said dispensing end of said magazine, said mechanism constituting means for selectively releasing said first lowermost support plate when said dispensing end is positioned atop a pipette tip rack in response to contact of said mechanism by structure carried by said tip rack, whereby to dispense said first lowermost layer of pipette tips into said tip rack, and further including a plurality of following support plates, each with apertures arranged in said pattern and loaded with pipette tips, said following support plates being organized in stacked arrangement with respect to said first lowermost support elate to form a plurality of nested layers of pipette tips, including said first lowermost layer of pipette tips, in said magazine, wherein said support plate stop mechanism is structured and arranged to release a single support plate upon contact with structure carried by a tip rack and to stop all support plates above the single support plate so released until said mechanism is again contacted by structure carried by a tip rack, whereby the following layer of pipette tips proximal said first lowermost layer of pipette tips replaces said first lowermost layer of pipette tips to become a subsequent lowermost layer of pipette tips in said magazine.

16. An assembly according to claim 15, wherein said support plate stop mechanism is structured and arranged to provide a releasable restraint for dispensing support plates, one-at-a-time through said dispensing end, and is further structured and arranged to guide each said support plate, in turn, into a dispensing position.

17. An assembly according to claim 16 wherein said support plate stop mechanism comprises:

a first plate stop structure located to contact a first edge of said first lowermost support plate;

a second plate stop structure located to contact a second edge of said lowermost support plate opposite said first edge;

said first and second plate stop structures being shaped and dimensioned to guide said tip rack into a dispensing position with respect to said dispensing end of said magazine;

said first and second plate stop structures further being structured and arranged to geometrically interfere with said tip rack, whereby to displace into a release position in response to positioning of said tip rack in said dispensing position.

18. A pipette tip storage and tip rack loading assembly, comprising:

a magazine constructed with approximately vertical sidewalls defining a storage volume, said storage volume having an open bottom shaped and dimensioned to register with a pipette tip rack which has an upper surface interrupted with receptacles structured to receive individual pipette tips, said receptacles being arranged in a pattern;

a plurality of support plates in vertical stacked arrangement within said storage volume, each plate being provided with apertures arranged in said pattern, and carrying an array of pipette tips installed in said apertures, such that the pipette tips of each said array, except the lowermost said array, nest in the pipette tips of the next lower array in said stacked arrangement; and structural retaining elements associated with said vertical sidewalls positioned to block the lowermost said support plate of said stacked arrangement from exiting said open bottom, said retaining elements being structured and arranged to interact with a pipette tip rack when said magazine is positioned in registration with said rack, whereby to release the lowermost said support plate to move past said retaining elements towards said open bottom so that the pipette tips carried by said lowermost support plate drop into registration with said receptacles of said pipette tip rack, and a subsequent support plate of said stacked arrangement becomes a new lowermost said support plate, wherein said retaining elements are further structured and arranged such that immediately upon removal of said magazine from said rack following release of a lowermost support plate of said stacked arrangement, said release elements operate to block in turn each succeeding new such lowermost support plate of said stacked arrangement, wherein said retaining elements comprise spring members carried by opposite side walls of said magazine.

19. An assembly according to claim 18, wherein said spring members each have a first, lower end anchored to a said sidewall and a second, upper end biased inward into blocking position with respect to said lowermost support plate, said spring members being structured and arranged for engagement by a said pipette tip rack inserted into said open bottom of said magazine, whereby said upper ends are forced against their biases out of said blocking position.

20. Apparatus for positioning pipette tips on a support, the apparatus comprising:

a lower apertured plate for holding the pipette tips in a lower layer;

a magazine having a narrowing disposed at a lower end of said magazine to hold said lower apertured plate on an outer edge thereof;

a following apertured plate for holding the pipette tips in a following layer within said magazine, said following apertured plate stacked above said lower apertured plate in said magazine; and an activating device manually operatable from outside the magazine by cooperating with an upper edge of the support to widen said narrowing in an elastic fashion substantially without exercising force on said following apertured plate for releasing said lower apertured plate, wherein said following apertured plate then moves into a position assumed by said lower apertured plate prior to release.

* * * * *